US005819146A

United States Patent [19]

Roderick

[11] Patent Number: 5,819,146

[45] Date of Patent: Oct. 6, 1998

[54] MAGNETIC BRUSH ROLLER HAVING A WIRE-WOUND FLOATING HUB

[76] Inventor: Sheldon Lee Roderick, 10641 W. 102nd Pl., Westminster, Colo. 80021

[21] Appl. No.: 813,517

[22] Filed: Mar. 7, 1997

[51] Int. Cl.[6] ..... G03G 15/00; G03G 15/08

[52] U.S. Cl. ..... 399/276; 399/108; 403/229; 464/57; 464/182

[58] Field of Search ..... 399/276, 109, 399/275, 270, 280; 403/229, 220; 464/182, 179, 162, 169, 160, 57, 78

[56] References Cited

U.S. PATENT DOCUMENTS

| | | | |
|---|---|---|---|
| 4,135,927 | 1/1979 | Draugelis et al. | 399/270 X |
| 4,517,274 | 5/1985 | Honda et al. | 430/122 |
| 4,526,130 | 7/1985 | Fukuda et al. | 399/276 |
| 4,834,571 | 5/1989 | Greenburg | 403/229 X |
| 4,876,574 | 10/1989 | Tajima et al. | 399/275 |
| 4,934,990 | 6/1990 | Backers | 464/57 X |
| 4,989,044 | 1/1991 | Nishimura et al. | 399/275 |
| 5,027,745 | 7/1991 | Yamazaki et al. | 399/276 |
| 5,052,335 | 10/1991 | Enoguchi et al. | 399/280 |
| 5,149,914 | 9/1992 | Koga et al. | 399/270 |
| 5,202,729 | 4/1993 | Miyamoto et al. | 399/103 |
| 5,274,426 | 12/1993 | Gosekie et al. | 399/276 |
| 5,671,636 | 9/1997 | Gagne et al. | 464/57 X |

*Primary Examiner*—Arthur T. Grimley
*Assistant Examiner*—Sophia S. Chen
*Attorney, Agent, or Firm*—F. A. Sirr; E. C. Hancock; Holland & Hart llp

[57] ABSTRACT

A xerographic developer apparatus wherein the idler end of a hollow and rotatably mounted developer roller is resiliently supported for radial movement by a radially compliant hub. The hub comprises a unitary series of stainless coils that are wound about an axis of rotation of the developer roller. The series of wire coils include a first multi-turn end portion to physically engage the roller's idler end, an opposite multi-turn end portion to engage a bearing that is fixed in position to generally coincide with the roller's axis of rotation, and an intermediate multi-turn portion that is free of physical engagement with either of the roller's idler end or the bearing. The intermediate multi-turn portion resiliently support the roller's idler end for needed radial movement relative to the bearing.

20 Claims, 5 Drawing Sheets

MAGNETIC BRUSH ROLLER HAVING A WIRE-WOUND FLOATING HUB

BACKGROUND OF THE INVENTION

1. Field of the Invention

This invention relates to the field of xerography or electrophotography, and to the use of a magnetic brush developer roller to deposit toner on an electrostatic latent image that is carried by a moving photoreceptor, such as a photoconductor belt or drum that moves or rotates in a path that is adjacent to the rotating development roller(s) of a magnetic brush developer apparatus. More specifically, this invention provides a wire-wound floating hub that resiliently supports one end of a magnetic brush developer roller, this floating hub being formed by a plurality of circularly wound coils of a nickel plated stainless steel wire.

2. Description of the Related Art

A wide variety of magnetic brush developer apparatus are known in the xerographic art, including developer apparatus having one or more rotating rollers that carry a single-component toner or a two-component toner to a development nip that is formed between the roller(s) and an electrostatic latent image that is carried by a closely adjacent and moving photoreceptor belt or drum. Both contact toner development and jumping toner development of the latent image are known. It is also known that the photoconductor and developer roller may move in the same relative direction within the development nip, or they may move in opposite directions within the development nip.

The following United States patents are of general interest relative to magnetic brush developer apparatus. U.S. Pat. No. 4,517,274 relates to a method for developing electrostatic latent images wherein a magnet is contained within a rotating delivering sleeve that carries developing particles. U.S. Pat. No. 4,876,574 describes a developing apparatus having a developing sleeve that is made of aluminum. U.S. Pat. No. 5,052,335 describes a developing device having an endless toner support member that is loosely fitted over the outer periphery of an electrically conductive drive roller. The drive roller is formed of aluminum, stainless steel, or is formed by winding electrically conductive material such as nitrile rubber, silicone rubber, styrene rubber or butadiene rubber around the periphery of a metal roller. The tubular shaped and loosely-fitting member that supports the toner is formed of a soft resinous sheet that is made of polycarbonate, nylon or fluoroplastic, or a sheet of such a resin mixed with carbon, metallic powder, or a thin film that is made of nickel, stainless steel or aluminum, or a laminated sheet of the resinous sheet and the metallic thin film. U.S. Pat. No. 5,149,914 provides a development member that is covered by a tubular shaped membrane member, the membrane member being driven by a drive roller through frictional engagement. The membrane member may be formed of natural rubber, silicone rubber, urethane rubber, butadiene rubber, chloroprene rubber or NBR. The use of a membrane member formed of a metal foil, such as phosphor bronze, stainless steel or nickel, or formed of a resin membrane material, such as nylon, polyamide or polyethylene terephthalate is suggested. The use of a conductive layer containing a conductive metal such as Al or Ni is suggested.

Other publications of general interest include U.S. Pat. No. 5,027,745 whose development roller has a surface containing carbon fibers, and U.S. Pat. No. 5,202,729 whose development roller comprises a metal base having a resin coating in which fine conductive particles are dispersed.

An important utility of the present invention is in the rebuilding, refurbishing, or remanufacturing of spent developer apparatus; i.e., the remanufacturing, or recycling, of developer apparatus whose limited supply of toner has been depleted during a prior of use in a xerographic reproduction device.

U.S. Pat. Nos. 4,989,004 and 5,274,426, incorporated herein by reference, show such an expendable developer apparatus having a developing sleeve comprising a cylindrical aluminum or stainless steel base member, this base member having an outer surface coating that is made of resin material in which electrically conductive fine particles, such as fine graphite, are dispersed.

While the art, as exemplified above, is generally useful for its limited intended purposes, the need remains in the art for a rotating development roller whose end mounting means provides resilient compliance to an engineering design location, for example the location of an adjacent moving photoconductor. This need is particularly important in the art of rebuilding, or refurbishing, user-replaceable and toner-spent magnetic brush developers, so that these spent developers can be reused within the xerographic copiers/printer with which the magnetic developer was supplied upon original purchase of the xerographic copier/printer.

SUMMARY OF THE INVENTION

This invention provides a magnetic brush developer roller that is usable within the developer apparatus of a wide variety of well-known xerographic devices, examples of which are copier devices, facsimile devices, computer output printer devices, and the like.

The present invention is usable in the new-build or original-manufacture of single or multiple roller magnetic brush developer apparatus.

In addition, the present invention is useful in refurbishing, recycling, or rebuilding, existing magnetic brush developer apparatus wherein the developer apparatus is resupplied with toner and is generally refurbished for reuse in a xerographic device. This utility of the invention relates generally to that field of xerographic devices wherein the original manufacturer designed the developer apparatus with the intent that when the toner within the original developer apparatus was used-up, the entire original developer apparatus would be removed and replaced with a new or a refurbished developer apparatus having at least a new supply of toner.

In its broadest aspects, this invention provides a hollow magnetic brush roller having at least one end that is supported for rotation about an axis, wherein this one end of the roller is provided with a wire-wound and radially-resilient mounting hub that facilitates movement of that end of the roller generally normal to the roller's axis of rotation. One utility of the present invention is to maintain a constant-dimension development gap between the toner-bearing and cylindrical outer surface of the roller and an adjacent portion of a photoconductor that carries a latent image that is to be developed by toner.

In a preferred embodiment of this invention, the above-mentioned resilient mounting hub comprises a unitary series of closely-spaced and circular cross-section coils of wire that are wound about an axis that generally coincides with the axis of rotation of the roller. A roller-supporting-end of this wire coil is press-fit into the inner diameter of one end of the development roller in a manner to frictionally mount the wire coil to this end of the roller. The other end of the wire coil is then somewhat loosely located within a bearing.

When so positioned, this one end of the roller is axially spaced a short distance from the bearing, and mid turns of the wire coil operate to resiliently support this one roller end for radial movement relative to the axis of rotation of the roller.

An object of this invention is to provide a xerographic developer apparatus having a supply of toner and a hollow and rotatably mounted developer roller whose outer surface operates to carry a quantity of toner to a development gap, or nip, that includes a moving electrostatic latent image that passes adjacent to said developer roller. One end, i.e. the idler or non-driven end, of this developer roller is mounted for possible radial movement by means of a compliant, wire-wound, hub that resiliently supports this one end of the developer roller for movement generally normal to the moving electrostatic latent image. The radially compliant hub of this invention thereby operates to maintain a substantially constant-dimension development nip between the developer roller and the moving electrostatic latent image, as the developer roller and the electrostatic latent image experience relative movement.

Another object of the invention is to provide a method for rebuilding a xerographic developer apparatus that has a limited supply of toner, and a hollow, cylindrical cross-section, and rotatably mounted developer roller, wherein the developer roller includes an outer surface that carries a quantity of toner to a moving electrostatic latent image that passes through a development nip that is located adjacent to the cylindrical outer surface of the developer roller. The rebuilding method of this invention comprises removing the developer roller from a developer apparatus whose supply of toner has become depleted, removing a rigid hub from one end of the developer roller, providing a resilient coil-wound hub at this one end of the developer roller, replacing the developer roller in the developer apparatus, and replenishing the developer apparatus with a new supply of toner.

These and other features, advantages and objects of the invention will be apparent to those of skill in the art upon reference to the following detailed description, which description makes reference to the drawing.

DESCRIPTION OF THE PREFERRED EMBODIMENTS

Figure 1:
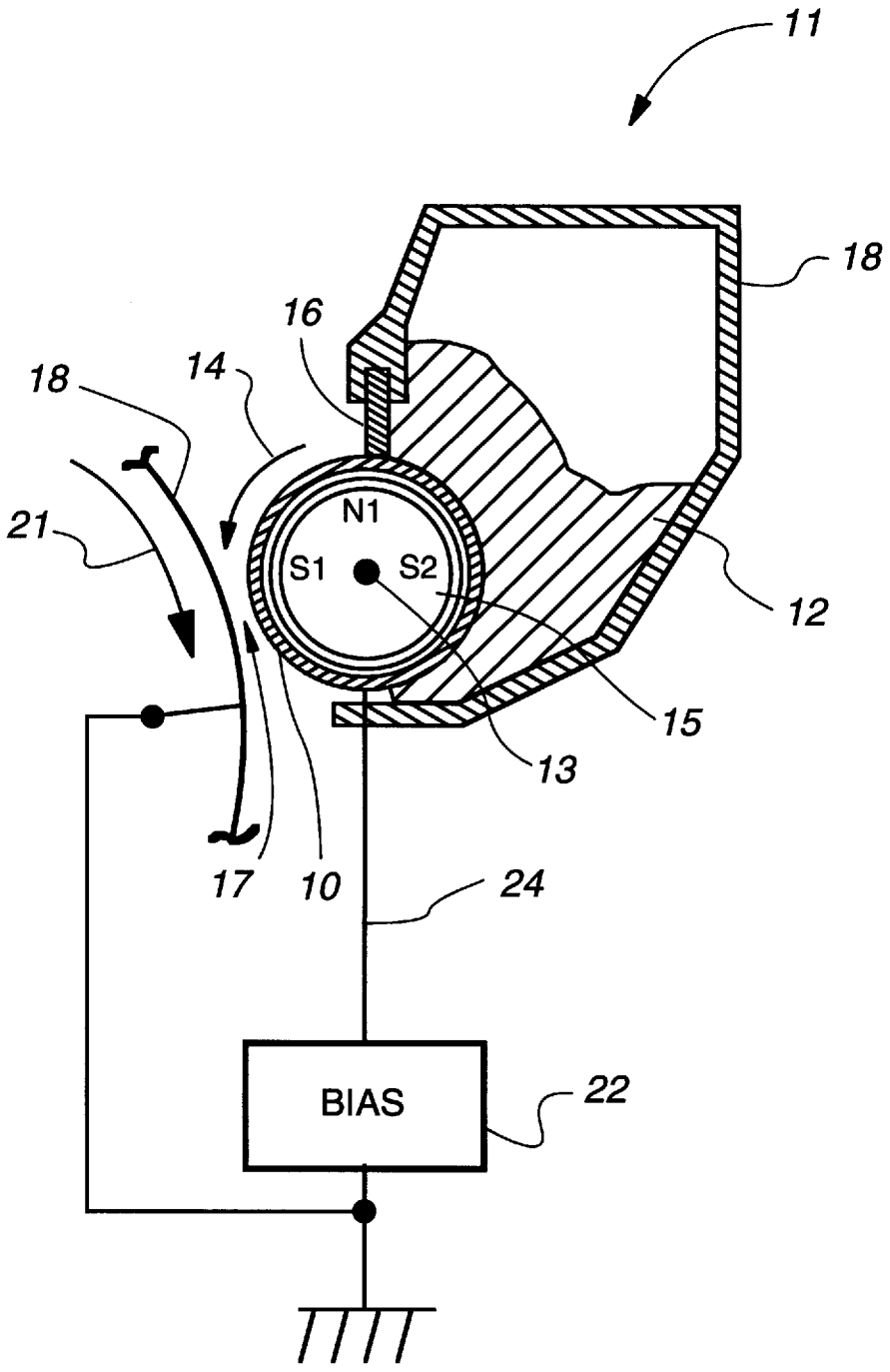
Fig. 1 Prior Art
FIG. 1 is a diagrammatic showing of an original equipment, prior art, and replaceable xerographic developing apparatus.
Figure 2:
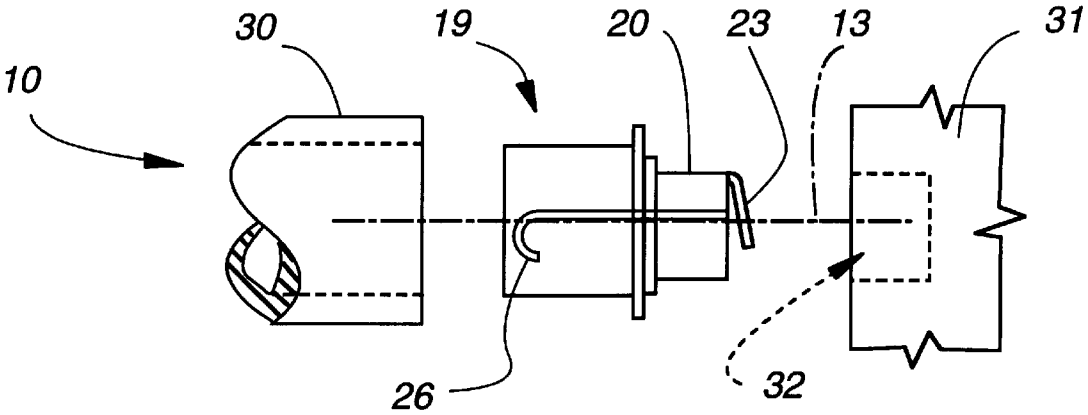
Fig. 2 Prior Art
FIG. 2 is a side view of a rigid plastic idler plug or hub that supports one end of the developer roller shown in FIG. 1, which idler hub is replaced by the wire-wound hub construction and arrangement of the present invention during refurbishing of the FIG. 1 developing apparatus.

While the present invention is not limited thereto, in embodiments of the invention, the wire-wound resilient hub of the present invention is used to replace a non-compliant, or rigid, plastic hub 19 of FIG. 2 that was originally supplied with developer rollers, such as roller 10 of FIG. 1. Examples are rollers 10 taken from spent developer apparatus taken from Canon, Xerox and Pitney Bowes xerographic printers.

In all cases, when the refurbished developer apparatus were returned to an original-equipment xerographic device, the print/copy quality that was provided by the refurbished devices, now including developer rollers in accordance with this invention, was equivalent to that provided by the original equipment developer apparatus.

While the invention is usable with electrically-conductive aluminum and stainless steel magnetic brush rollers, the invention finds equal utility with dielectric developer rollers; for example, rollers that are made from mineral filled plastics.

With reference to FIG. 1, a valuable utility of the present invention is in the rebuilding, refurbishing or recycling of well-known original equipment developer apparatus 11 that includes a metal magnetic brush roller 10, a unitary housing 18, and a limited supply of xerographic toner 12. Examples are replaceable developer apparatus 11 used in xerographic printers supplied by companies such as Canon, Xerox and Pitney Bowes.

While the details of construction of such original equipment developer apparatus 11 vary somewhat from one manufacturer to the other, all such developer apparatus 11 include the limited supply of toner 12, and at least one hollow, electrically conductive, circular cross-section cylinder, magnetic brush developer roller 10.

Roller 10 is rotationally driven by a gear means (not shown) that engages a driven axial end of roller 10. In one such original equipment developer apparatus 11, the driven end of developer roller 10 is provided with an electrically nonconductive and rigid plastic hub (not shown) that is non-rotatably secured to the inner-diameter surface of end of roller 10. The exposed end of this driven hub includes four planar drive surfaces that extend generally parallel to the roller's axis of rotation 13 and are oriented to form a box-like configuration. When roller 10 is located in its operating position within developer apparatus 11, these four drive surfaces occupy an inserted position within a rotatable drive gear. This drive gear physically supports this driven end of roller 10. Rotation of this drive gear produces, for example, CCW rotation 14 of roller 10 about axis 13.

The opposite idler end of developer roller 10 includes a second electrically nonconductive and rigid plastic idler hub 19, as shown in FIG. 2. Idler hub 19 is non-rotatably secured to the inner diameter surface of this idler end of roller 10. Idler hub 19 non-compliantly supports this idler end of roller 10. Idler hub 19 includes a rigid plastic and circular cylinder extension 20 that fits within a fixed-position bearing (not shown); for example, within the inner race of a bearing.

With reference to FIG. 1, a stationary magnet shaft 15 is provided within roller 10. As is well known, magnet shaft 15 provides a desired configuration to a development magnetic field at the location of a small development nip, space or gap 17. Rotating roller 10 and a stationary toner doctoring blade(s) 16 that is mounted closely adjacent to the outer cylindrical surface of roller 10, cooperate in a well-known manner to feed a controlled-thickness layer of toner 12 to the development gap 17 that is formed with a photoreceptor or photoconductor 18 that carries a latent electrostatic image on the surface thereof. As is well known, movement of photoconductor 18 may be in the same direction as rotation 14 of roller 10, as is shown by CW movement 21, or this relative movement may be an opposite or CCW direction.

In a well-known manner, toner 12 is selectively deposited only on the photoconductor's latent electrostatic image. As a result of the toner development of latent images over a period of time, developer apparatus 11 eventually becomes depleted of its limited toner supply 12. As is both conventional and well known, a development electrode voltage source, or a jumping development voltage source 22, may be connected between electrically conductive developer roller 10, and a backing substrate (not shown) on which photoconductor 18 is carried.

FIG. 2 shows how the roller's rigid, non-conductive and plastic idler hub 19 includes a wire, or conductor, 23 that operates to connect FIG. 1's electrical conductor 24 to the inner cylindrical surface or diameter of roller 10. Wire 23 terminates at an end portion 26 that electrically and physically engages the inner cylindrical surface of roller 10 in a stationary manner once hub 19 is non-rotatably mounted onto the idler end 30 of roller 10. FIG. 2 also shows how the idler end 30 of developer roller 10 into which idler hub plug 19 is mounted, as by press-fitting is supported coincident with axis 13 by means of a bearing member 31. Bearing member 31 includes a circular cross section cylindrical cavity 32 that is mounted in a manner to establish the position of the roller's axis of rotation 13. The cylindrical extension 20 of idler hub 19 relatively loosely and rotatably fits within bearing cavity 32, to thereby locate the central axis of roller 10 to be coincident with axis 13. As will be appreciated, bearing member 31 may be made of metal, or it may comprise a plastic bearing member having a metal member or conductor to which wire 23 electrically connects when idler hub 19 is in place on bearing member 31.

Once toner supply 12 of FIG. 1 is exhausted, the user may purchase an original-equipment developer apparatus 11, and then replace the spent developer apparatus. However, an industry has been developed whereby spent original-equipment developer apparatus 11 are refurbished, recycled or rebuilt, and then offered for sale in competition with original-equipment developer apparatus.

It is to be noted that the present invention provides both a recycling utility and a new-build utility for developer apparatus 11, such as shown in FIG. 1.

Figure 4:
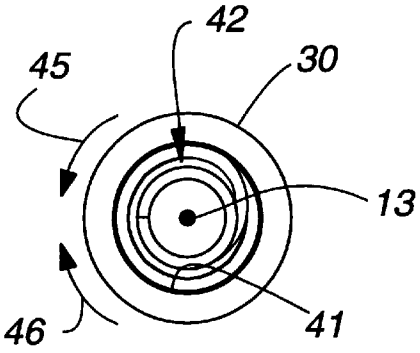
FIG. 4 is an end view of the wire-wound resilient hub of FIG. 3 as seen from line 4—4 of FIG. 3.
Figure 3:
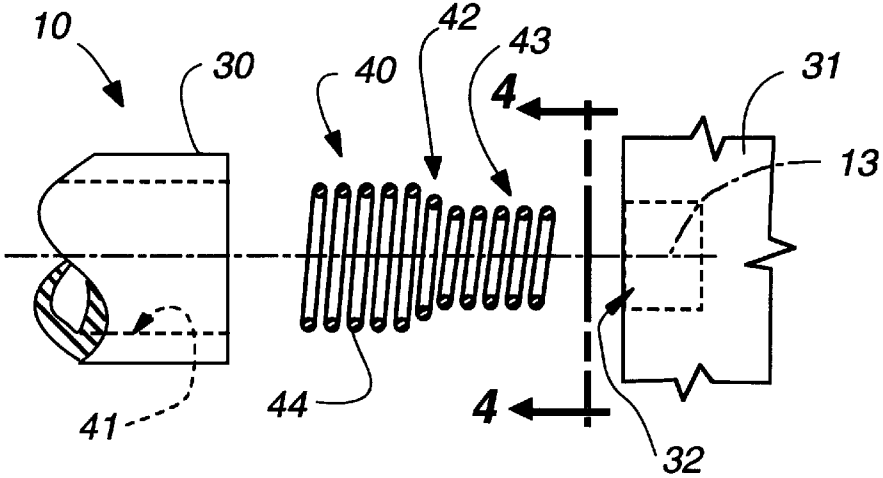
FIG. 3 is a side view of a wire-wound resilient hub of this invention, this hub being usable in the new manufacture of a developer roller, such as is shown in FIG. 1, and this hub also being usable to replace the rigid plastic idler hub of FIG. 2 during the refurbishing of a developing apparatus shown in FIG. 1.

FIG. 3 is a side view that is generally similar to FIG. 2 that shows the wire-wound resilient hub 40 of the present invention. FIG. 4 is an end view of hub 40, taken along the line 4—4 of FIG. 3. FIG. 4 also shows how the series of coils of hub 40 are circular, and are concentrically wound about the roller's axis of rotation 13.

Electrically conductive wire wound hub 40 is functionally equivalent to FIG. 2's electrically nonconductive and rigid plastic idler hub 19 in that hub 40 also (1) physically supports the idler end 30 of roller 10 coincident with the roller's axis of rotation 13, and (2) provides an electrical connection between FIG. 1's electrical conductor 24 and the inner cylindrical surface 41 of a metal developer roller 10.

However, in addition to these two functions, the intermediate or mid coil-portion 42 of hub 40 enables the idler end 30 of roller 10 to move radially in a new and unusual manner relative to axis 13, as may be required by the construction and arrangement of an associated developer apparatus. This radial movement, of roller end 30 may be occasioned, for example, by an out-of-round condition of roller 10, or by an out-of-round condition of a photoreceptor drum with which roller 10 forms a development nip. As the term is used herein, the intermediate or mid-portion 42 of hub 40 is defined as those intermediate-position or mid-position coils of wire that are not contained within, or held by, either the idler end 30 of roller 10 or by bearing cavity 32.

Hub 40 includes a small-diameter circular cylinder extension or portion 43 that fits within bearing cavity 32. As is apparent, this small-diameter hub extension 43 operates to provide an electrical connection between roller 10 and FIG. 1's bias voltage source 22. Hub 40 also includes a large-diameter circular cylinder extension 44 that is press-fit, or frictionally mounted, inside of the hollow idler end 30 of roller 10. As will be apparent, this hub extension 44 also operates to connect FIG. 1's electrical conductor 24 to the inner cylindrical surface 41 of roller 10.

In an embodiment of this invention, hub 40 comprises a total of about sixteen turns of a wire that was selected from the group copper-beryllium wire, copper-coated stainless steel wire, nickel-plated stainless steel wire, and stainless steel wire, having a diameter in the range of about 0.021 to about 0.036-inch. The total axial length of hub 40, as measured along axis 13, was about 0.7-inch. The large-diameter end portion 44 of hub 40 comprised about eight wire turns, and was in the range of from about 0.3 to about 0.35-inch in axial length. The intermediate portion 42 of hub 40 comprises about three wire turns and was about 0.02-inch in axial length. The small-diameter portion 43 of hub 40 comprised about four wire turns and was in the range of from about 0.3 to about 0.35-inch in axial length. The outer diameter of large diameter portion 44 of hub 40 was about 0.58-inch. The outer diameter of small-diameter portion 43 of hub 40 was about 0.43-inch. While not critical to the invention, in this embodiment of the invention, the wire turns of hub 40 were closely packed so that each individual wire turn physically engaged adjacent two wire turns.

Within the spirit and scope of this invention, cavity 32 of bearing member 31 may either comprise a rotatable inner race of a bearing 31, or cavity 32 may comprises a cylindrical bearing surface that is stationary relative to hub extension 43. When a movable inner bearing race 32 is provided, no relative movement need occur between bearing race 32 and hub extension 43. When bearing cavity 32 provides a stationary bearing surface 32, relative movement occurs between stationary bearing surface 32 and hub extension 43. In this later case, it is desirable that the wire-winding direction of hub 40 be such that the wire-end of hub extension 43 extend in a downstream direction relative to the relative movement that occurs between hub extension 43 and cavity 32. This condition is shown in FIG. 4 by means of a first arrow 45 that shows the direction of rotation of hub extension 43 relative to a stationary bearing surface 32, and by means of a second arrow 46 that shows the direction in which the wire coils of hub 40 are wound from end 44 to end 43. It will be noted that with direction 46 of coil winding, and with direction 45 of rotation of development roller 10, the other wire-end that is associated with hub extension 44 will tend to dig into inner roller surface 41, thus ensuring that hub 40 is nonrotatably secured within the hub's cylindrical interior surface 41.

In addition, while preferred embodiments of this invention provide that resilient wire-wound hub 40 consist of a large diameter portion 44 that is non-movably press-fitted into a hollow cylindrical roller 10, and a small-diameter portion 43 that is placed into a stationary bearing race 32 or into a movable bearing race 32, it is within the spirit and scope of this invention that hub 40 comprise closely stacked coils of wire that have generally the same diameter throughout the entire axial length of hub 40.

In addition, it may be that those skilled in the art will find utility for this invention by providing a construction and arrangement wherein the two opposite axial ends 43,44 of wire-wound hub 40 encircle the outside surface of one end of a shaft that is to be supported by either the inner surface or the outer surface of a bearing member such as 31. In this case, end 43 of the coils of hub 40 are supported by an inner bearing surface as is shown in FIG. 3, or these end coils 43 operate to encircle and be supported by an outer bearing surface.

Figure 5:
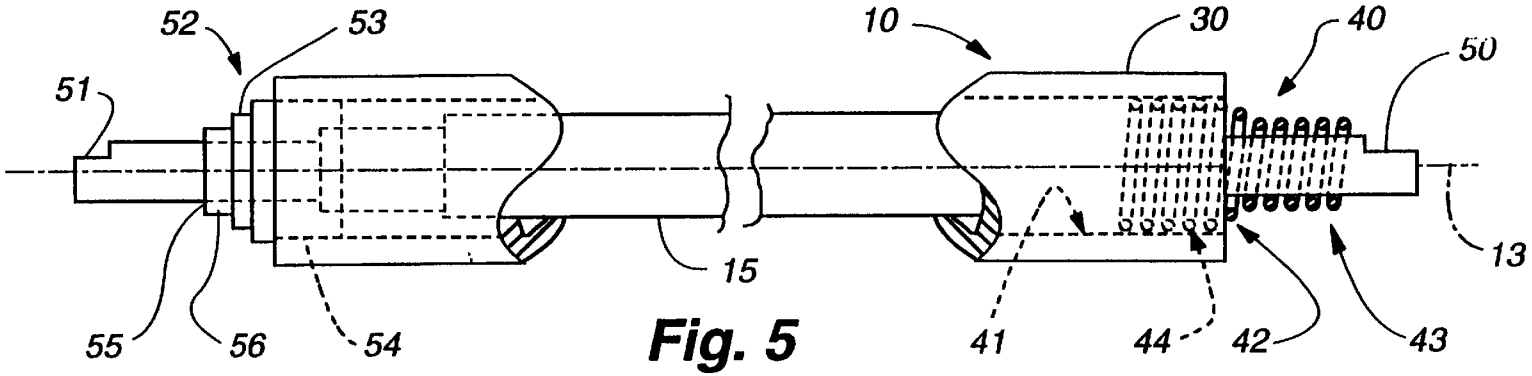
FIG. 5 is a side view of an assembled developer roller wherein the large diameter end of the resilient hub of FIGS. 3, 4 has been inserted within the inner diameter of the idler end of the roller.

FIG. 5 is a side view of developer roller 10 with hub 40 of this invention inserted in place within idler end 30. In this assembled position, the wire coils that make up hub portion 44 frictionally and nonrotatably engage the roller's inner cylindrical surface 41. As can be seen from this view, centrally disposed magnet rod 15 includes two end surfaces 50,51 that enable magnet rod 15 to be non-rotatably clamped in place within FIG. 1's developer apparatus 11. In this construction and arrangement of a developer roller 10, the central axis of both roller 10 and magnetic rod 15 extend coincident with axis 13.

As stated previously, roller 10 is constructed and arranged to be rotationally driven by a drive means that engages the axial driven end 52 of roller 10. While not critical to the invention, one manner of accomplishing this roller-drive function is to provide driven end 52 of developer roller 10 with an insulating and rigid plastic hub 53 that is non-rotatably secured to the inner diameter surface 54 of the driven end 52 of roller 10. The extending end 55 of this driven hub includes a mechanical configuration that enables developer roller 10 to be driven. For example, extending end 55 may include one, two, four, or more planar drive surfaces 56 that extend generally parallel to the roller's axis of rotation 13 and are oriented relative to each other so as to form a box-like configuration. When roller 10 is located in its operating position within developer apparatus 11, the four drive surfaces 56 occupy an inserted position within a rotatable drive gear. This drive gear physically supports driven end 52 of roller 10, and rotation of this drive gear produces CCW rotation 14 of roller 10 about axis 13.

Figure 6:
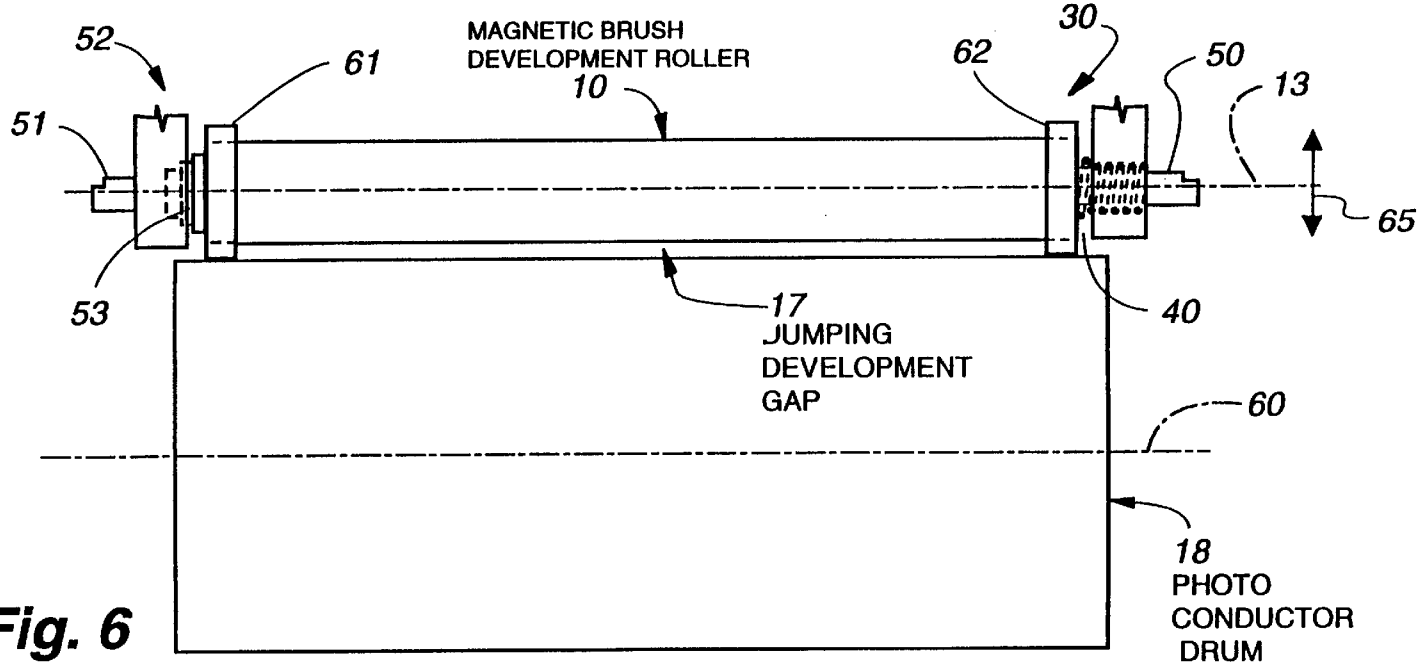
FIG. 6 shows an assembled developer roller of FIG. 5 as it is rotatably supported in toner-developing relation with a photoconductor drum.

FIG. 6 shows the assembled developer roller 10 of FIG. 5 as it is rotatably supported coincident with axis 13, and in toner-developing relation with a photoconductor drum 18 whose axis of rotation is identified as 60. As is conventional, axes 13 and 60 are mutually parallel.

In this embodiment of the invention, both the driven end 52 and the idler end 30 of roller 10 include an electrically nonconductive and rigid plastic ring 61 and 62, respectively. Rings 61 and 62 non-movably encircle the outer surface of these two ends of roller 10. The general function of rings 61 and 62 is to establish and maintain toner-jumping-development gap 17 between the outer surface of roller 10 and the outer surface of drum 18 upon which an electrostatic latent image is carried.

In this embodiment of the invention, radial compliance of wire wound hub 40 enables the idler end 30 of roller 10 to move radially, as shown by arrow 65, as is needed to accommodate any dimensional tolerance variations that may be present in the assembly.

Figure 7:
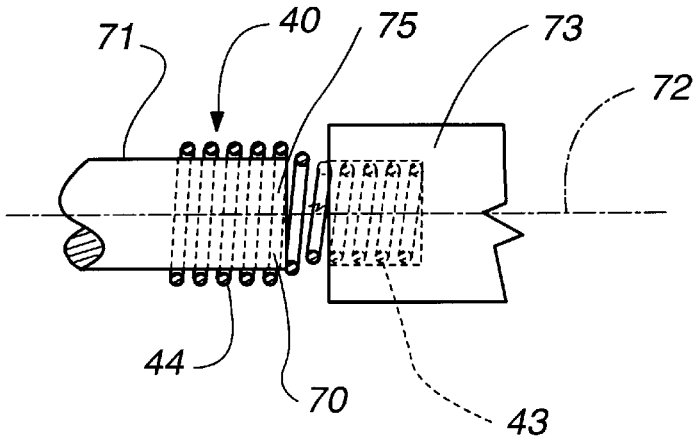
FIG. 7 shows a more general utility of the present invention wherein the wire-wound and radially resilient coil hub is used to resiliently support the idler end of a shaft.

While the invention has been above described while making reference to a unique and important xerographic developer apparatus utility, FIG. 7 shows a more general utility wherein wire-wound radially resilient wire coil hub 40 is used to resiliently support the end 70 of a shaft 71 for rotation on an axis 72. In this construction and arrangement of the invention, a bearing 73 rotatably accepts hub portion 43, whereas hub portion 44 encircles and frictionally grips the exterior surface 75 of the end 70 of shaft 71.

Figure 8:
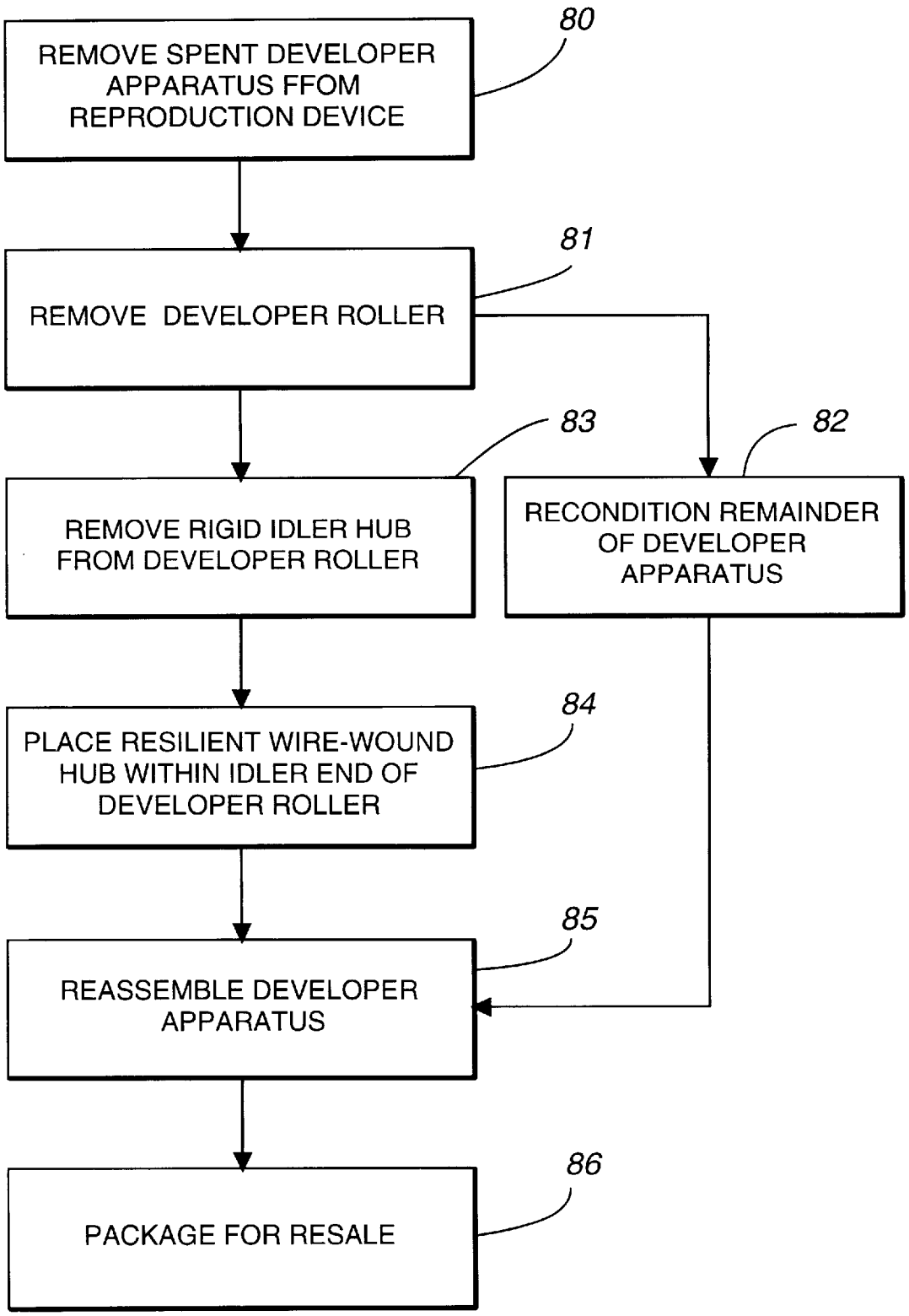
FIG. 8 is a flowchart type of showing of the present invention wherein a xerographic developer apparatus is rebuilt and then packaged for sale and reuse in a xerographic reproduction device, for example, the type reproduction device with which the developer apparatus was originally supplied as a new-build developer apparatus.

FIG. 8 is a flowchart type of showing of the present invention wherein a xerographic developer apparatus, such as 11 of FIG. 1, is rebuilt and then packaged for sale and reuse in a xerographic reproduction device, such as the type with which the developer apparatus was originally supplied as a new-build developer apparatus.

As a first step 80 of the FIG. 8 process, the spent xerographic developer apparatus that is to be rebuilt is removed from the xerographic reproduction device. Usually, the need to rebuild the developer apparatus is caused by the depletion of a limited supply of toner that is contained within the developer apparatus.

At step 81, developer roller 10 is removed from the developer apparatus. FIG. 3 is an example of such a removed developer roller 10.

At step 82, the remainder of the developer apparatus is generally reconditioned. A number of events may take place at step 82, usually including replenishing the developer apparatus with a new and a limited supply of toner. Other events may include cleanup/replacement of various developer seals, bearings, and the like that are within the developer apparatus. Reconditioning of the outer cylindrical surface of developer roller 10 may be provided, for example, as is described in PCT patent application PCT/US95/06496 filed 23 May 1995.

At step 83 of the FIG. 8 process, the rigid idler hub 19 of FIG. 2 is removed from the idler end 30 of developer roller 10. Idler hub 19 is discarded as it will not be used in the rebuilt developer apparatus.

At step 84, a resilient coil-wound hub 40, as above described, is inserted into the inner diameter, and at the idler end 30, of developer roller 10. As above described, resilient coil-wound hub 40 is constructed and arranged to be a fully functional equivalent to the removed rigid idler hub 19, and additionally provides radially resilient support of idler end 30. Step 84 usually also includes a general refurbishing of developer roller 10. While these additional steps are important to the rebuilding of the developer apparatus, these steps form no part of this invention. Examples are a general cleanup/replacement of the various roller/magnet parts, replacement/cleanup of seals and bearings, and perhaps a reconditioning of the outer toner-carrying cylindrical surface of roller 10. FIG. 5 shows a rebuilt roller assembly.

At step 85, the rebuilt roller assembly of FIG. 5 and the rebuilt output of step 82 are brought together and reassembled into a rebuilt developer apparatus, such as apparatus 11 of FIG. 1. The end product of the rebuilding process is then packaged for resale at 86.

Figure 9:
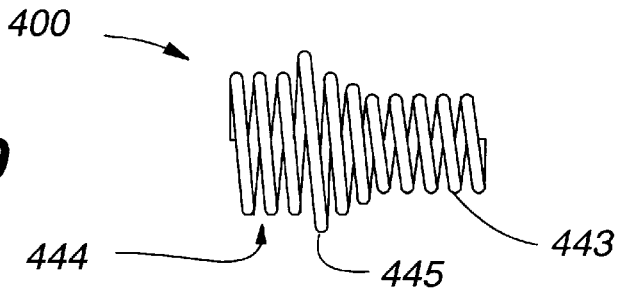
FIG. 9 shows an embodiment wherein the wire-wound resilient hub of this invention includes one or more radially extending or larger diameter coil turns that operate to limit the extent of insertion of the hub into the inner diameter surface of a developer roller.

FIG. 9 shows an embodiment wherein wire-wound resilient hub 400 of this invention includes one or more radially extending or larger diameter coil turns 445 that operate to limit the extent of insertion of hub 400 into the inner diameter surface of developer roller 10, as shown in FIG. 3. More specifically, coil turn 445 are of a large diameter so as to physically engage the idler end 30 of roller 10 when all of the hub turns 444 have been inserted into to mate with the inner cylindrical surface 41 of roller 10. As can be seen from FIG. 9, hub 400 includes a small diameter end 443 that is the equivalent of hub end 43 shown in FIG. 3. As will be readily apparent to those of skill in the art, coil turns 445 may also be of a smaller diameter, so as to limit the extent of placement of hub 400 over the outside cylindrical surface of a solid roller 10 or another type of a driven shaft.

Figure 10:
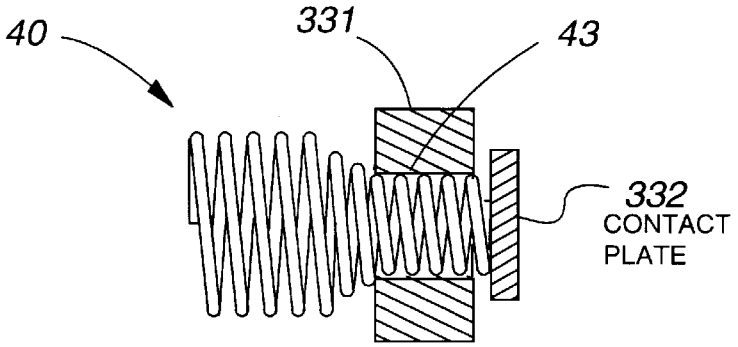
FIG. 10 is a showing somewhat like that of FIG. 3 wherein the developer roller's idler end bearing member is associated with a stationary metal electrical contact plate that electrically contacts the small diameter end of the resilient hub of this invention.

FIG. 10 is a showing somewhat like that of FIG. 3 wherein the developer roller's idler end bearing member 331 is associated with a stationary metal electrical contact plate 332 that electrically contacts the small diameter end 43 of the resilient hub 40 of this invention. By virtue, the physical/electrical engagement of plate 332 and hub coil end 43, a voltage, such as a development electrode voltage, may be applied to developer roller 10 of FIG. 3.

Figure 11:
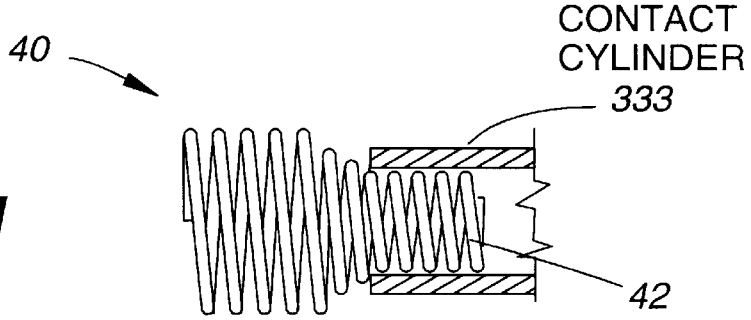
FIG. 11 is a showing somewhat like that of FIG. 10 wherein the developer roller's idler end bearing member comprises a stationary or rotary metal electrical contact cylinder that electrically contacts the small diameter end of the resilient hub of this invention.

FIG. 11 is a showing somewhat like that of FIG. 10 wherein the developer roller's idler end bearing member comprises a stationary, or rotary metal electrical contact cylinder 333, that electrically contacts the small diameter end 43 of the resilient hub 40 of this invention. Again, by virtue the physical/electrical engagement of contact cylinder 333 and hub coil end 43, a voltage, such as a development electrode voltage, may be applied to developer roller 10 of FIG. 3.

This invention has been described in detail while making reference to preferred embodiments of the invention. However, it is apparent that those skilled in the art will, upon learning of this invention, visualize yet other embodiments that are within the spirit and scope of this invention. Thus, this detailed description is not to be taken as a limitation on the spirit and scope of this invention.

What is claimed is:

1. In xerographic developer apparatus having a supply of toner and a hollow and rotatable mounted developer roller, said developer roller having an outer surface that operates to carry a quantity of said toner supply to a moving electrostatic latent image that passes adjacent to said developer roller, the improvement comprising:

an idler end of said developer roller having a radially compliant hub that supports said idler end of said developer roller for radial movement generally normal to said moving electrostatic latent image during rotation of said developer roller;

said radially compliant hub operating to maintain a substantially constant development gap between said outer surface of said developer roller and said moving electrostatic latent image as said developer roller and said electrostatic latent image experience relative movement.

2. The apparatus of claim 1 wherein:

said radially compliant hub comprises a unitary series of wire coils that are wound about an axis of rotation of said developer roller.

3. A method of rebuilding a xerographic developer apparatus that has a supply of toner and a hollow, cylindrical, and rotatably-mounted developer roller, said developer roller having an outer cylindrical surface that operates to carry toner to a moving electrostatic latent image that passes through a development nip adjacent to said outer surface of said developer roller, said developer roller including a rigid drive hub mounted at a drive end of said developer roller, and said developer roller including a rigid idler hub that is located at an opposite idler end of said roller, said method comprising the steps of:

removing said developer roller from a developer apparatus that is to be rebuilt;

removing said rigid idler hub from said idler end of said developer roller;

placing a resilient coil-wound hub at said idler end of said developer roller, said resilient coil-wound hub being constructed and arranged to be a function equivalent to said removed rigid idler hub; and replacing said developer roller in said developer apparatus.

4. The method of claim 3 including the step of:

replenishing said developer apparatus with toner.

5. The method of claim 3 wherein said cylindrical developer roller defines an elongated axis of rotation that extends along a central of said cylindrical developer roller, said method including the step of:

providing said resilient wire-wound hub as a continuous series of wire coils that are formed from a single continuous length of wire, said series of coils being concentrically wound about said axis or rotation.

6. Apparatus for supporting an idler end of a rotating shaft on an axis of rotation by way of a bearing member that is located on said axis of rotation, comprising:

a radially resilient and wire-wound idler hub, said idler hub having;

a first wire coil end portion configured to mate with said idler end of said shaft;

a second wire coil end portion configured to mate with said bearing member, and an intermediate wire coil portion that is located intermediate said first and second wire coil end portions; and said intermediate wire coil portion being free of physical engagement with either said idler end of said shaft or said bearing member.

7. The apparatus of claim 6 wherein:

said wire-wound hub is formed from a continuous length of wire that is selected from the group copper-beryllium wire, copper coated stainless steel wire, nickel plated stainless steel wire, and stainless steel wire.

8. The apparatus of claim 6 wherein:

said wire-wound idler hub comprises a unitary series of wire coils that are wound about an axis of rotation of said shaft, said series of wire coils including one or more barrier-coil-turns that operate to control placement of said hub on said idler end of said shaft.

9. The apparatus of claim 8 wherein said series of wire coils includes:

a first-diameter multi-turn end portion operable to physically engage said idler end of said shaft;

said first multi-turn end portion including said one or more barrier-coil-turns as a portion thereof;

a second and small-diameter multi-turn end portion operable to engage a bearing that is fixed in position to generally coincide with said axis of rotation of said shaft, and a third and progressively-smaller-diameter multi-turn portion that is free of physical engagement with either of said idler end of said shaft or said bearing, and that operates to connect said first end portion to said second end portion;

said third multi-turn portion operating to resiliently support said idler end of said shaft for radial movement relative to said bearing.

10. In xerographic developer apparatus having a supply of toner and a hollow and rotatable mounted developer roller, said developer roller having an outer surface that operates to carry a quantity of said toner to a moving electrostatic latent image that passes adjacent to said developer roller, the improvement comprising:

an idler end of said developer roller having a radially compliant hub that supports said idler end of said developer roller for radial movement generally normal to said moving electrostatic latent image during rotation of said developer roller;

said radially compliant hub operating to maintain a substantially constant development gap between said outer surface of said developer roller and said moving electrostatic latent image as said developer roller and said electrostatic latent image experience relative movement;

said radially compliant hub comprises a unitary series of wire coils that are wound about an axis of rotation of said developer roller; and said series of wire coils including a first multi-turn end portion operable to physically engage said idler end of said developer roller, an opposite multi-turn end portion operable to engage a bearing that is fixed in position to generally coincide with said axis of rotation of said roller, and an intermediate multi-turn portion that is free of physical engagement with either of said idler end of said developer roller or said bearing;

said intermediate multi-turn portion operating to resiliently support said idler end of said developer roller for radial movement relative to said bearing.

11. The apparatus of claim 10 wherein said wire coils are wound from a continuous length of wire that is selected from the group copper-beryllium wire, copper coated stainless steel wire, nickle plated stainless steel wire, and stainless steel wire.

12. The apparatus of claim 10 wherein:

said first multi-turn end portion is operable to physically engage an inner diameter of said idler end of said developer roller in a stationay manner; and said opposite multi-turn end portion is operable to slideably engage an inner surface of a stationary bearing cavity that is fixed in position so as to generally coincide with said axis of rotation of said roller.

13. The apparatus of claim 12 wherein:

said radially compliant hub is wound in a direction so as to provide said opposite multi-turn end portion with a wire end that faces in a direction so as not to dig into said bearing cavity as said roller and said wire wound hub rotate as a unit relative to said stationary bearing cavity.

14. The apparatus of claim 13 wherein:

said first multi-turn end portion has a coil diameter that is larger than a a coil diameter of said opposite multi-turn end portion; and said intermediate multi-turn portion has a diameter that progressively reduces in diameter from said first multi-turn portion to said opposite multi-turn portion.

15. The apparatus of claim 14 wherein said wire coils comprise wire selected from the group copper-beryllium wire, copper coated stainless steel wire, nickle plated stainless steel wire, and stainless steel wire.

16. The apparatus of claim 10 wherein:

said radially compliant hub comprises a unitary series of wire coils that are wound about an axis of rotation of said developer roller, said series of wire coil including one or more barrier coil turns that operate to control placement of said hub on said idler end of said developer roller.

17. The apparatus of claim 16 wherein said series of wire coils includes:

a first-diameter multi-turn end portion operable to physically engage said idler end of said developer roller;

said first multi-turn end portion including said one or more barrier coil turns as a portion thereof;

a second and small-diameter multi-turn end portion operable to engage a bearing that is fixed in position to generally coincide with said axis of rotation of said roller, and a third and progressively-smaller-diameter multi-turn portion that is free of physical engagement with either of said idler end of said developer roller or said bearing, and that operates to connect said first end portion to said second portion; and said third multi-turn portion operating to resiliently support said idler end of said developer roller for radial movement relative to said bearing.

18. A method of rebuilding a xerographic developer apparatus that has a supply of toner and a hollow, cylindrical, and a rotatably-mounted developer roller that defines an elongated axis of rotation that extends along a central of said developer roller, said developer roller having an outer cylindrical surface that operates to carry toner to a moving electrostatic latent image that passes through a development nip adjacent to said outer surface of said developer roller, said developer roller including a rigid drive hub that is mounted at a drive end of said developer roller, said developer roller including a rigid idler hub that is located at an opposite idler end of said developer roller, said rigid idler hub being supported by a bearing that is located at a stationary position within said developer apparatus coincident with said axis of rotation, said method comprising the steps of:

removing said developer roller from a developer apparatus that is to be rebuilt;

removing said rigid idler hub from said idler end of said developer roller;

placing a resilient wire-wound hub at said idler end of said developer roller, said resilient coil-wound hub being constructed and arranged to be a functional equivalent to said removed rigid idler hub;

providing said wire-wound hub as a continuous series of wire coils that are formed from a single continuous length of wire, said series of coils being concentrically wound about said axis of rotation;

providing a first wire coil end portion of said wire-wound hub configured to press-fit within an inner diameter of said cylindrical developer roller;

providing a second wire coil end portion of said wire-wound hub configured to mate with said bearing, and providing an intermediate wire coil portion of said wire-wound hub;

said intermediate wire coil portion being located intermediate said first wire coil end portion and said second wire coil end portion of said wire-wound hub;

said intermediate wire coil portion being free of physical engagement with either of said inner diameter of said cylindrical developer roller or said bearing; and replacing said developer roller in said developer apparatus.

19. The method of claim 18 including the step of:

forming said wire-wound hub from wire selected from the group copper-beryllium wire, copper coated stainless steel wire, nickle plated stainless steel wire, and stainless steel wire.

20. The method of claim 19 including the step of:

replenishing said developer apparatus with toner.

* * * * *